US009145708B1

(12) United States Patent
Wald et al.

(10) Patent No.: US 9,145,708 B1
(45) Date of Patent: Sep. 29, 2015

(54) WIRE WINDER AND POST PULLER DEVICE

(71) Applicants: Gerard Wald, Wishek, ND (US); James F. Fandrich, Wishek, ND (US)

(72) Inventors: Gerard Wald, Wishek, ND (US); James F. Fandrich, Wishek, ND (US)

( * ) Notice: Subject to any disclaimer, the term of this patent is extended or adjusted under 35 U.S.C. 154(b) by 104 days.

(21) Appl. No.: 13/934,413

(22) Filed: Jul. 3, 2013

(51) Int. Cl.
*E04H 17/26* (2006.01)

(52) U.S. Cl.
CPC ..... *E04H 17/265* (2013.01); *E04H 17/266* (2013.01)

(58) Field of Classification Search
CPC ..... E04H 17/265; E04H 17/266
USPC ..... 254/30, 405, 415; 242/390.5, 397.1
See application file for complete search history.

(56) References Cited

U.S. PATENT DOCUMENTS

| | | | | |
|---|---|---|---|---|
| 5,242,152 | A * | 9/1993 | Schatz | 254/30 |
| 5,388,782 | A | 2/1995 | King | |
| 5,806,779 | A | 9/1998 | Crum | |
| 6,543,713 | B1 | 4/2003 | Frolander | |
| 6,830,211 | B2 | 12/2004 | Sloan | |
| 7,530,522 | B2 | 5/2009 | Popp | |
| 2008/0181756 | A1 | 7/2008 | Moffitt | |

* cited by examiner

*Primary Examiner* — Lee D Wilson
*Assistant Examiner* — Jamal Daniel
(74) *Attorney, Agent, or Firm* — Neustel Law Offices

(57) ABSTRACT

A wire winder and post puller device for aiding both in the retrieval of wire such as from a fence as well as the uprooting of installed posts. The wire winder and post puller device generally includes a frame adapted to be secured to loader arms of a loader. The frame supports a wire spool assembly which is adapted to be swung into and out of place via use of a support member rotatably secured to the frame. Wire may be wound onto the wire spool assembly through usage of a winding hydraulic motor which rotates the axle. Wire may be removed by swinging out the wire spool assembly from the frame and removing its first spool wheel. A post puller assembly is also provided to aid in removing posts from the ground in combination with the wire winder.

20 Claims, 6 Drawing Sheets

WIRE WINDER AND POST PULLER DEVICE

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a wire winder and post puller attachment for a loader and more specifically it relates to a wire winder and post puller device for aiding both in the retrieval of wire such as from a fence as well as the uprooting of installed posts.

2. Description of the Related Art

Any discussion of the related art throughout the specification should in no way be considered as an admission that such related art is widely known or forms part of common general knowledge in the field.

Fences comprised of posts linked by wire have been in use for many years for protecting personal property, enclosing livestock and various other purposes. Very often, such fences will need to be removed from a site for one reason or another. The task of removing such fences can be extremely burdensome, particularly where the fences are comprised of barbed wire fences.

In the past, individuals wishing to remove such a fence have been forced to manually cut and retrieve the wire between the fence posts. Doing so can lead to a tangled mess and, in some cases, injury to such an individual who is forced to wrestle with manually collecting and coiling such wire for further use or disposal. Further, it can be extremely difficult to remove posts left behind from the ground. Where machinery is used, it is often required that multiple devices be used for winding up the wire and removing the posts.

Because of the inherent problems with the related art, there is a need for a new and improved wire winder and post puller device for aiding both in the retrieval of wire such as from a fence as well as the uprooting of installed posts.

BRIEF SUMMARY OF THE INVENTION

The invention generally relates to a wire winder and post puller which includes a frame adapted to be secured to loader arms of a loader. The frame supports a wire spool assembly which is adapted to be swung into and out of place via use of a support member rotatably secured to the frame. Wire may be wound onto the wire spool assembly through usage of a winding hydraulic motor which rotates the axle. Wire may be removed by swinging out the wire spool assembly from the frame and removing its first spool wheel. A post puller assembly is also provided to aid in removing posts from the ground in combination with the wire winder.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
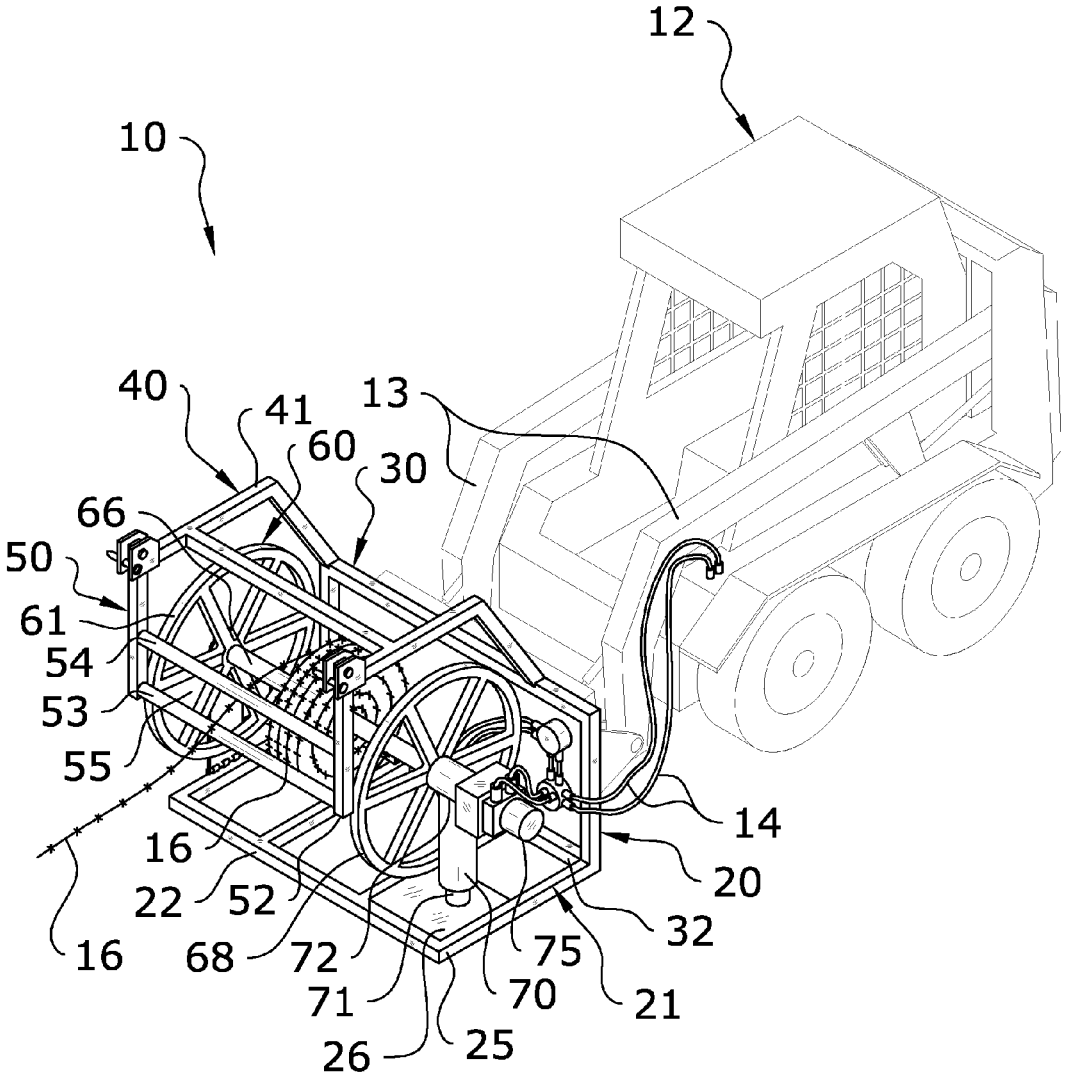
FIG. 1 is an upper perspective view of the present invention attached to a loader.

Turning now descriptively to the drawings, in which similar reference characters denote similar elements throughout the several views, FIGS. 1 through 6 illustrate a wire winder and post puller device 10, which comprises a frame 20 adapted to be secured to loader arms 13 of a loader 12. The frame 20 supports a wire spool assembly 60 which is adapted to be swung into and out of place via use of a support member 70 rotatably secured to the frame 20. Wire 16 may be wound onto the wire spool assembly 60 through usage of a winding hydraulic motor 75 which rotates the axle 66. Wire 16 may be removed by swinging out the wire spool assembly 60 from the frame 20 and removing its first spool wheel 61. A post puller assembly 80 is also provided to aid in removing posts from the ground in combination with the wire winder.

B. Frame

Figure 2:
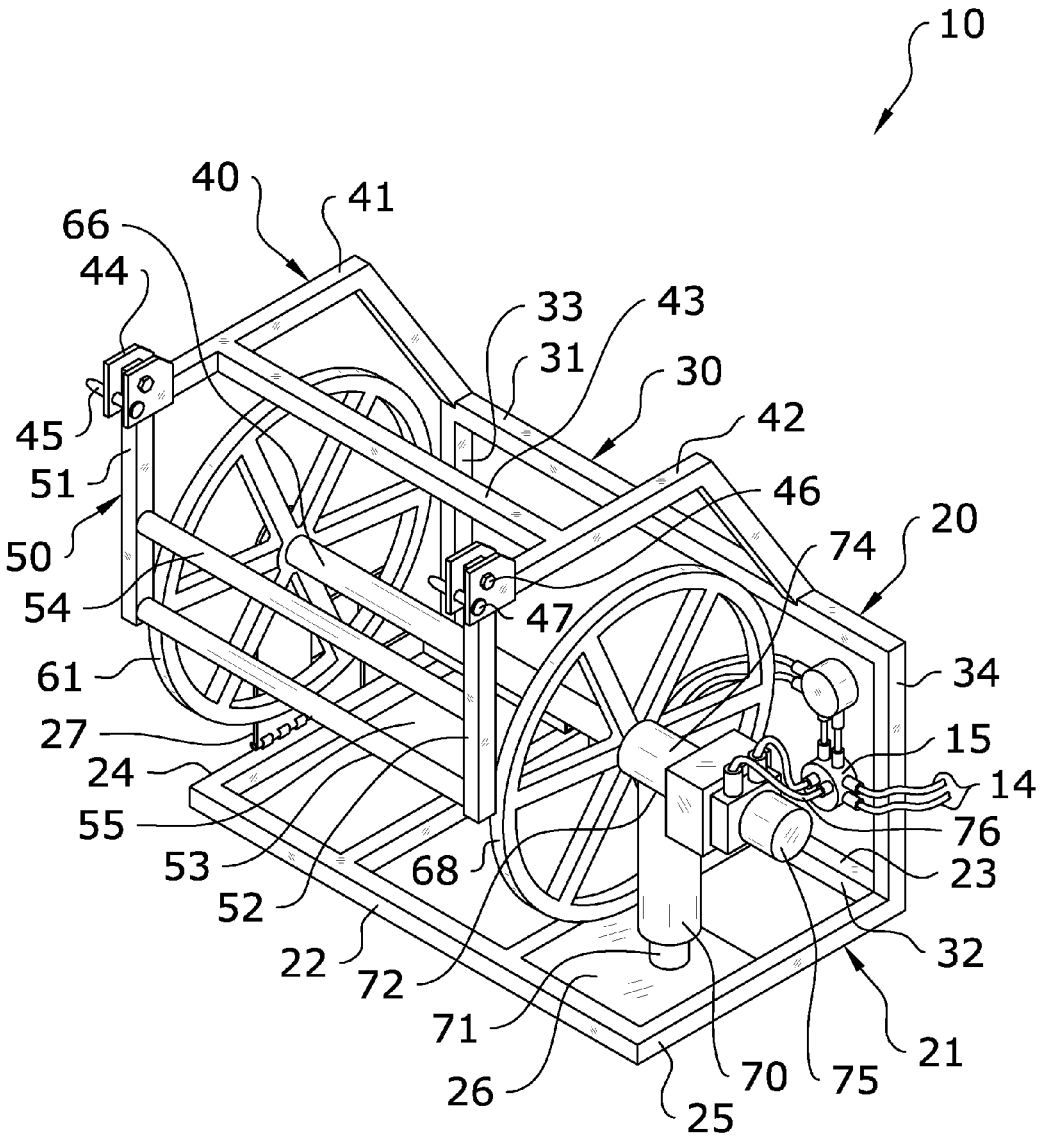
FIG. 2 is an upper perspective view of the present invention.

As shown in FIG. 2, the present invention includes a frame 20 which is removably secured to a vehicle such as a loader 12 via a pair of securing members 35, 36. The frame 20 provides support for the various components of the present invention. The frame 20 may be comprised of various configurations and should not be construed as being limited by the exemplary figures.

In a preferred embodiment as shown in the figures, the frame 20 is comprised of a horizontal portion 21 and a vertical portion 30. The frame 20 may be comprised of interconnected elongated members such as rods as shown in the figures, or may be comprised of various other configurations adapted to provide support for the other components. The frame 20 may be integrally formed of a unitary structure or may be formed of discrete, interconnected components.

The horizontal portion 21 is shown in the figures as being comprised of elongated members secured to each other in a rectangular configuration, including a front end 22, a rear end 23, a first side 24 and a second side 25. As best shown in FIG. 2, the horizontal portion 21, in embodiments utilizing interconnected elongated rods as shown, will include a panel 26 horizontally extending across the frame 20 to provide support for the swinging pedestal 70 of the present invention. The panel 26 will preferably be positioned adjacent the front end 22 and second side 25 of the horizontal portion 21 of the frame 20 for supporting the swinging motion of the wire spool assembly 60. It is appreciated that various other configurations may be utilized to support the support member 70, such as securing the support member 70 directly to the frame 20 itself or in other positions on the frame 20.

Figure 3:
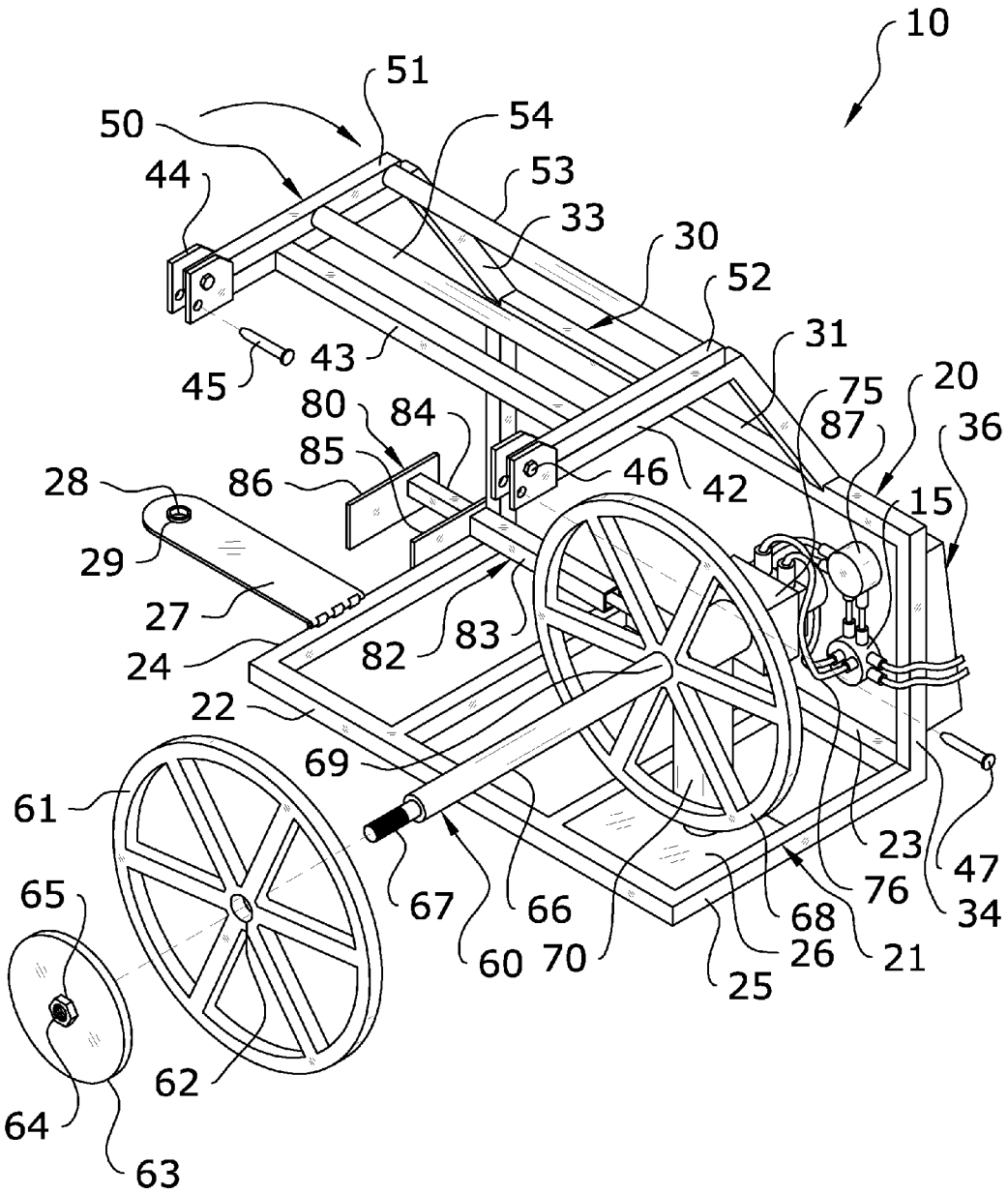
FIG. 3 is an upper perspective view of the present invention illustrating removal of the second spool wheel and retraction of the guide slot.
Figure 4:
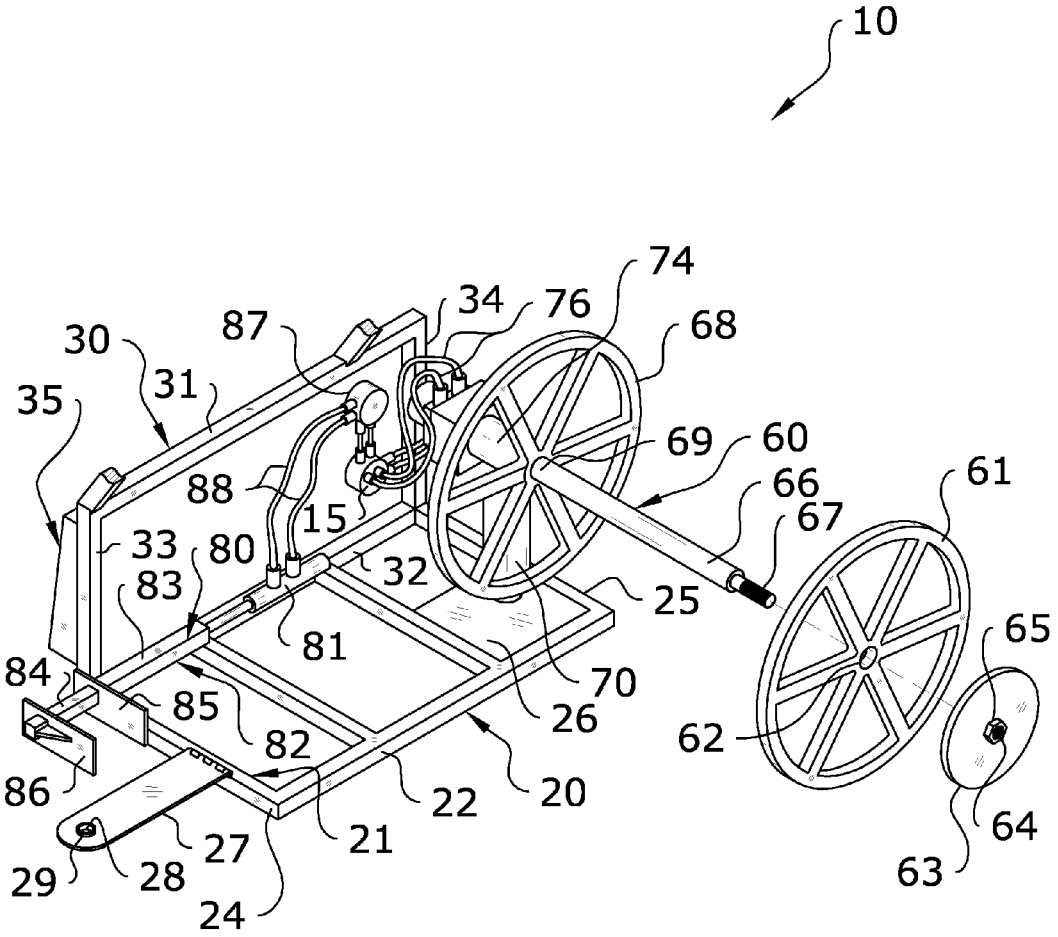
FIG. 4 is an upper perspective view of the present invention illustrating removal of the second spool wheel.

The horizontal portion 21 also includes a first spool retainer 27 as best shown in FIGS. 2-4. The first spool retainer 27 is preferably comprised of a structure hingedly secured to a first side 24 of the frame 20. The first spool retainer 27 includes an aperture 28 and bearing 29 for rotatably and removably engaging with the threaded end 67 of the axle 66 of the wire spool assembly 60. The first spool retainer 27 may be rotated into an upward position when retaining the wire spool assembly 60 as shown in FIG. 2 or may be rotated into a lowered position to allow removal of the first spool wheel 61 and allow retrieval of spooled wire 16 as shown in FIGS. 3 and 4.

The vertical portion 30 is similarly shown as being comprised of elongated members secured to each other to form a rectangular configuration, including an upper end 31, a lower end 32, a first side 33 and a second side 34, wherein the vertical portion 30's lower end 32 is comprised of the horizontal portion's 21 rear end 23 where they intersect. The vertical portion 30 of the frame 20 preferably includes an open portion such as shown in FIG. 1 to allow the second spool wheel 68 to freely rotate therein.

Figure 5:
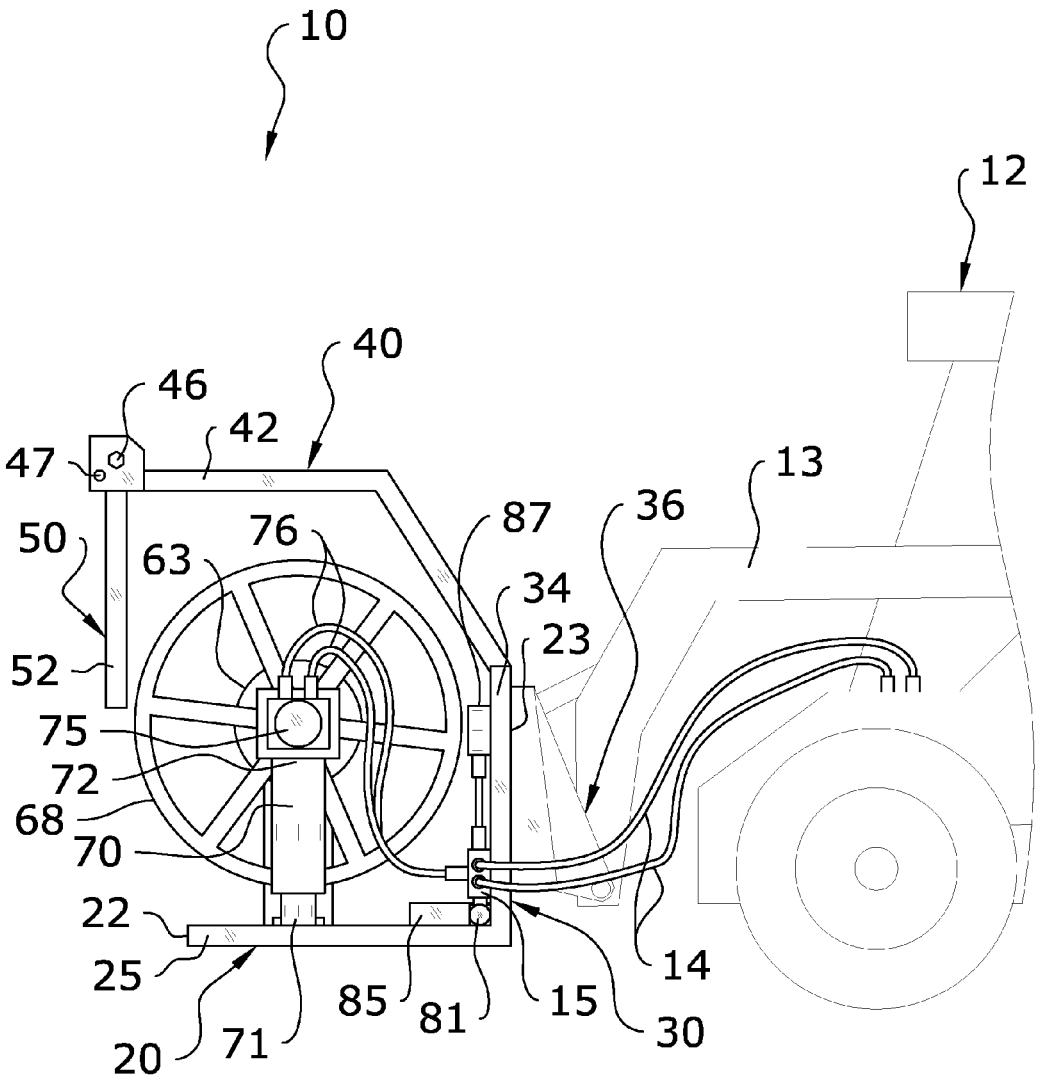
FIG. 5 is a first side view of the present invention secured to a loader.
Figure 6:
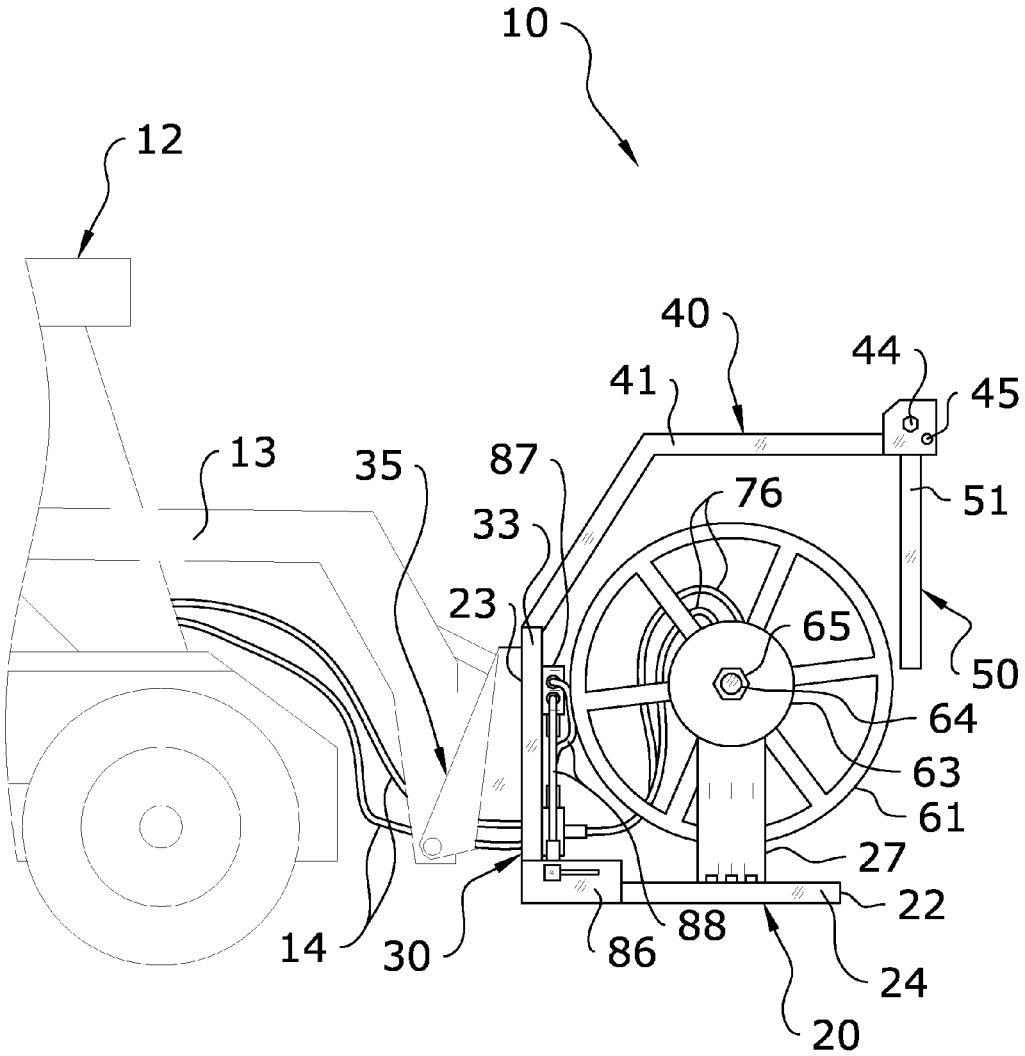
FIG. 6 is a second side view of the present invention secured to a loader.

The vertical portion 30 of the frame 20 includes a securing assembly 35, 36 which is utilized to removably secure the frame 20 to a vehicle such as a loader 12. Various types of assemblies and devices known in the art may be utilized to mount the present invention on such a vehicle. As best shown in FIGS. 5 and 6, one embodiment of the present invention utilizes a first securing member 35 extending from the first side 33 of the vertical portion 30 and a second securing member 36 extending from the second side 34 of the vertical portion 30. Each securing member 35, 36 is adapted to be removably secured to a corresponding loader arm 13 or other secure mounting structure on the vehicle 12.

C. Guide Support and Wire Guide

As shown in FIG. 2, a guide support 40 extends up and forward from the upper end 31 of the vertical portion 30 of the frame 20. The guide support 40 is utilized to support the hingedly secured wire guide 50 of the present invention. The guide support 40 may be integrally formed of a unitary structure with the frame 20 or may be comprised of a discrete structure secured thereto. The guide support 40 may be comprised of various configurations adapted to provide a structure to which the wire guide 50 may be hingedly secured.

In a preferred embodiment shown in the figures, the guide support 40 is comprised of a first arm 41 extending up and forward from the upper end 31 of the vertical portion 30 of the frame 20 adjacent its first side 33 and a second arm 42 extending up and forward from the upper end 31 of the vertical portion 30 of the frame 20 adjacent its second side 34 or slightly offset therefrom. A cross member 43 may extend between the first arm 41 and second arm 42 for additional support.

The distal end of the first arm 41 includes a first hinge 44 and the distal end of the second arm 42 includes a second hinge 46 as best shown in FIG. 2. The hinges 44, 46 are utilized to hingedly secure the respective arms 51, 52 of the wire guide 50 to the arms 41, 42 of the guide support 40. Various types of devices known in the art to hingedly secure two structures may be utilized for the hinges 44, 46 of the present invention, and thus its scope should not be construed as being limited by the exemplary figures.

In a preferred embodiment shown in the figures, each hinge 44, 46 will be comprised of a pair of plates secured on either side of the respective distal ends of the arms 41, 42 of the guide support 40 via a pivot pin extending therethrough. A locking pin 45, 47 may be selectively inserted through aligned apertures of the plates of each hinge 44, 46 to lock the wire guide 50 in a lowered position. By removing the locking pins 45, 46, the wire guide 50 will be allowed to swing up and back to rest on top of the guide support 40 as shown in FIG. 3.

The wire guide 50 acts to guide wire 16 onto the wire spool assembly 60 when the present invention is in use. The wire guide is best shown in FIG. 2 as being comprised of a first arm 51 and a second arm 52 extending parallel to each other. The first arm 51 of the wire guide 50 is hingedly secured to the first arm 41 of the guide support 40 and the second arm 52 of the wire guide 50 is hingedly secured to the second arm 42 of the guide support 40.

A first cross member 53 extends between the respective distal ends of the first arm 51 and second arm 52. A second cross member 54 similarly extends between the first arm 51 and second arm 52 a distance back and in parallel relationship with the first cross member 53. The first and second cross members 53, 54 together define a guide slot 55 through which wire 16 may be wound onto the wire spool assembly 60 when the present invention is in use. The guide slot 55 prevents the wire 16 from swinging around unpredictably, which can lead to injury to nearby individuals, damage to the vehicle 12 or tangled wire 16.

D. Wire Spool Assembly

The present invention includes a wire spool assembly 60 which is swingably secured onto the frame 20 via a rotatable support member 70. The wire spool assembly 60 is adapted to be secured in a first position as shown in FIG. 2 for winding wire 16 thereon and also swung into a second position as shown in FIGS. 3 and 4 to allow wound wire 16 to be removed from the spool assembly 60.

The wire spool assembly 60 includes a first spool wheel 61 removably secured to the first end 67 of a rotating axle and a second spool wheel 68 fixedly secured to the second end 69 of the rotating axle 66. The axle 66 is rotatably driven by a winding motor 75 which is shown as being comprised of an orbital hydraulic motor in the figures, though other types of motors such as electric motors may be utilized. The rotation of the axle 66 will allow wire 16 to be spooled thereonto as shown in FIG. 1.

The axle 66 may be directly connected to the drive shaft of the winding motor 75 or may be fixedly secured to a winding connector 74 which is fixedly secured around the drive shaft of the motor 75 as shown in FIG. 2. It is preferable to utilize a winding connector 74 to more effectively be secured to the swinging support member 70 of the present invention as well as to insulate the drive shaft of the motor 75 from damage caused by vibrations of the support member 70 as the best present is in use.

As best shown in FIGS. 2-4, the first spool wheel 61 is adapted to be removed from the first end 67 of the axle 66 when the wire spool assembly 60 is swung out from the frame 20 as shown in FIG. 3. The first spool wheel 61 includes a central opening 62 through which the first end 67 of the axle 66 will extend. An end plate 63 is positioned on the outer end of the first spool wheel 61 which includes a threaded opening 64 and nut 65 through which the first end 67 of the axle 66 will be threaded, as best shown in FIG. 3. The nut 65 will rotatably secure within the bearing 29 of the aperture 28 on the first spool retainer 27.

The second spool wheel 68 is generally fixedly secured to the second end 69 of the axle 66 and, in some cases, may be integrally formed of a unitary structure therewith. In some embodiments, the second spool wheel 68 may rotate with the axle 66 and in other embodiments, the axle 66 may rotate within the second spool wheel 68.

The spool wheels 61, 68 of the present invention may be comprised of various configurations and thus should not be construed as limited to the exemplary structures shown in the figures. By way of example, the spool wheels 61, 68 would not necessarily have to be round and, in some embodiments, could be comprised of various shapes.

E. Post Puller Assembly

The present invention includes a post puller assembly 80 which aids with pulling up fence posts during or after retrieval of wire 16 therefrom. The post puller assembly 80 is best shown in FIG. 4. While the figures illustrate the post puller assembly 80 extending from the first side 24 of the horizontal portion 21 of the frame 20, it is appreciated that it could be positioned at different locations in alternate embodiments.

As shown in FIG. 4, the post puller assembly 80 is generally comprised of a bias member 81 comprised of a hydraulic cylinder. A telescoping member 82 comprised of an outer member 83 and inner member 84 slidably positioned within the outer member 83 is driven by the bias member 81.

The outer member 83 is fixedly secured to the frame 20, such as to the rear end 23 of the horizontal portion 21 adjacent to its first side 24 as shown in the figures. The inner member 84 is fixedly secured to the end of the bias member 81 such that the bias member 81 causes the inner member 84 to extend outwardly from and/or retract back into the outer member 83.

To aid with uprooting and removing posts, the outer member 83 will include a fixedly secured first jaw 85 at its distal end. Similarly, a second jaw 86 will be fixedly secured to the distal end of the inner member 84 such that the force from the bias member 81 on the inner member 84 will cause the second jaw 86 to advance toward and/or away from the fixed first jaw 85. By positioning the jaws 85, 86 around a post and tightening the second jaw 86 toward the first jaw 85 with the bias member 81, the post may be firmly gripped and then removed from the ground by utilizing the loader 12 to adjust positioning of the frame 20.

F. Hydraulic Interconnections

The figures illustrate usage of hydraulics for both the winding motor 75 of the wire spool assembly 60 and the bias member 81 of the post puller assembly 80. Various configurations may be utilized. In a preferred embodiment as shown in the figures, the hydraulic line 14 from the loader 12 will be connected to a hydraulic splitter 15. The hydraulic splitter 15 will be linked from one end with the winding motor 75 by one or more hydraulic lines 76 and from the other end with the bias member 81 by one or more puller hydraulic lines 88. In some embodiments, a relief valve 87 may be positioned between the splitter 15 and the bias member 81 to prevent damage to posts during removal.

G. Operation of Preferred Embodiment

In use, a wire 16 end is first secured through the guide slot 55 and secured onto the axle 66. By activating the winding motor 75, the axle 66 will rotate and thus draw in and wind up the wire 16 onto the axle 66. When it is desired to remove the wound wire 16 from the axle 66, the wire spool assembly 60 may be swung out by disengaging the first spool retainer 27 from the first spool wheel 61, swinging the spool assembly 60 outward through usage of the rotating support member 70, and then removing the end plate 63 and first spool wheel 61 from the axle 66, as best shown in FIGS. 3 and 4. The first spool wheel 61 and end plate 63 may then be resecured and the wire spool assembly 60 may then be swung back into place and secured by the first spool retainer 27 for further use.

When a post is reached, the jaws 85, 86 of the post puller assembly 80 will be positioned around the post. The second jaw 86 will be retracted toward the first jaw 85 to create a firm fit around the post, at which time the loader 12 may be activated to draw the frame 20, and thus the jaws 85, 86 upwardly to remove the post.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A wire winder and post puller device, comprising:

a frame;

a wire spool assembly rotatably secured to said frame, wherein said wire spool assembly is adapted to wind and collect wire from a fence; and a telescoping member secured to said frame for grasping and retrieving posts from underneath a surface, wherein said telescoping member comprises a first jaw and a second jaw.

2. The wire winder and post puller device of claim 1, wherein said frame includes a horizontal portion and a vertical portion.

3. The wire winder and post puller device of claim 2, further comprising a wire guide hingedly secured to said vertical portion of said frame.

4. The wire winder and post puller device of claim 2, further comprising a guide support extending upwardly and forward from an upper end of said vertical portion of said frame.

5. The wire winder and post puller device of claim 4, further comprising a wire guide hingedly secured to a distal end of said guide support.

6. The wire winder and post puller device of claim 2, wherein said wire spool assembly is comprised of a first spool wheel, a second spool wheel and an axle extending therebetween.

7. The wire winder and post puller device of claim 6, wherein said first spool wheel is removably secured to a first end of said axle and said second spool wheel is fixedly secured to a second end of said axle.

8. The wire winder and post puller device of claim 7, further comprising a rotatable support member connecting said second end of said axle with said horizontal portion of said frame.

9. The wire winder and post puller device of claim 8, wherein said axle is rotatably driven by a hydraulic motor.

10. The wire winder and post puller device of claim 1, said telescoping member being driven by a hydraulic bias member.

11. A wire winder and post puller device, comprising:

a frame;

a wire spool assembly rotatably secured to said frame, wherein said wire spool assembly is adapted to wind and collect wire from a fence;

a guide support extending from said frame;

a telescoping member secured to said frame for grasping and retrieving posts from underneath a surface, wherein said telescoping member comprises a first jaw and a second jaw; and a wire guide hingedly secured to a distal end of said guide support.

12. The wire winder and post puller device of claim 11, wherein said frame includes a horizontal portion and a vertical portion.

13. The wire winder and post puller device of claim 11, further comprising a post puller assembly secured to said frame for grasping and retrieving posts from underneath a surface.

14. The wire winder and post puller device of claim 12, wherein said guide support extends upwardly and forward from an upper end of said vertical portion of said frame.

15. The wire winder and post puller device of claim 12, wherein said wire spool assembly is comprised of a first spool wheel, a second spool wheel and an axle extending therebetween.

16. The wire winder and post puller device of claim 15, wherein said first spool wheel is removably secured to a first end of said axle and said second spool wheel is fixedly secured to a second end of said axle.

17. The wire winder and post puller device of claim 16, further comprising a rotatable support member connecting said second end of said axle with said horizontal portion of said frame.

18. The wire winder and post puller device of claim 17, wherein said axle is rotatably driven by a hydraulic motor.

19. A wire winder and post puller device, comprising:

a frame, wherein said frame includes a horizontal portion and a vertical portion;

a wire spool assembly rotatably secured to said frame, wherein said wire spool assembly is adapted to wind and collect wire from a fence, wherein said wire spool assembly is comprised of a first spool wheel, a second spool wheel and an axle extending therebetween, wherein said first spool wheel is removably secured to a first end of said axle and said second spool wheel is fixedly secured to a second end of said axle;

a rotatable support member connecting said second end of said axle with said horizontal portion of said frame;

a hydraulic motor for rotatably driving said axle;

a telescoping member secured to said frame for grasping and retrieving posts from underneath a surface, wherein said telescoping member comprises a first jaw and a second jaw;

a guide support extending upwardly and forward from an upper end of said vertical portion of said frame; and a wire guide hingedly secured to a distal end of said guide support.

20. The wire winder and post puller device of claim 19, said telescoping member being driven by a hydraulic bias member.

* * * * *